US008055147B2

(12) United States Patent
Koshimura et al.

(10) Patent No.: US 8,055,147 B2
(45) Date of Patent: Nov. 8, 2011

(54) IMAGE FORMING APPARATUS HAVING A CALIBRATION SECTION FOR AN IMAGE DENSITY SENSOR

(75) Inventors: Yasushi Koshimura, Tokyo (JP); Toru Yamaguchi, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 587 days.

(21) Appl. No.: 12/017,380

(22) Filed: Jan. 22, 2008

(65) Prior Publication Data

US 2008/0226316 A1 Sep. 18, 2008

(30) Foreign Application Priority Data

Mar. 15, 2007 (JP) ..... 2007-066417

(51) Int. Cl.
*G03G 15/00* (2006.01)

(52) U.S. Cl. ..... 399/74; 399/49; 399/59

(58) Field of Classification Search ..... 399/38, 399/49, 53, 59, 62, 74
See application file for complete search history.

(56) References Cited

U.S. PATENT DOCUMENTS 5,250,988 A * 10/1993 Matsuura et al. ..... 399/42
5,805,192 A 9/1998 Sasaki et al.
5,950,042 A * 9/1999 Goto et al. ..... 399/53
6,463,227 B1 10/2002 Denton et al.
2003/0091356 A1* 5/2003 Komatsu et al. ..... 399/49
2004/0208661 A1* 10/2004 Kitagawa et al. ..... 399/49
2005/0025510 A1* 2/2005 Yamada et al. ..... 399/49

FOREIGN PATENT DOCUMENTS

JP 2000-81739 A 3/2000
JP 2000-267369 A 9/2000
JP 2002-236402 A 8/2002
JP 2009222848 A * 10/2009
JP 2009294430 A * 12/2009

OTHER PUBLICATIONS

European Search Report for European Patent Application 08150347.6-2209 mailed Jul. 16, 2008 with English Translation.

* cited by examiner

*Primary Examiner* — David Porta
*Assistant Examiner* — Casey Bryant
(74) *Attorney, Agent, or Firm* — Cantor Colburn LLP

(57) ABSTRACT

Toner images of reference patterns having different resolutions are formed on an image carrier, image densities of the toner images of reference patterns are detected by a density sensor, and an output of the density sensor, when the detected densities equate among the reference patterns having different resolutions formed with the same image forming condition, is memorized as a reference value for calibrating the output the density sensor.

14 Claims, 8 Drawing Sheets

IMAGE FORMING APPARATUS HAVING A CALIBRATION SECTION FOR AN IMAGE DENSITY SENSOR

This application is based on Japanese Patent Application No. 2007-066417 filed on Mar. 15, 2007, in Japanese Patent Office, the entire content of which is hereby incorporated by reference.

BACKGROUND OF THE INVENTION

The present invention relates to an image forming apparatus.

In the image forming apparatus of the electrophotographic method, there is carried out image quality control where a toner image of a reference pattern is formed on an image carrier such as a photoconductive substance and an image density of the toner image is detected by an image sensor then the detected result is fed back to image forming conditions.

By such image quality control, effects caused by a change of an environment or a change of characteristic of each component configuring the image forming apparatus are eliminated and a high quality image is consistently formed.

In the above image control, an output characteristic of the density sensor such as sensitivity heavily affects the control.

Therefore, countermeasures to cope with a fluctuation of the density sensor used in image quality control are suggested.

In unexamined Japanese Patent Application Publication No. 2000-81739, it is suggested that an output of the density sensor is compensated based on an effect of change of amount of light emitted from a light emitting element configuring the density sensor, and an effect of a change of a surface condition of the image carrier on which the reference pattern is formed.

In unexamined Japanese Patent Application Publication No. 2000-267369, it is suggested that by providing a detection device for an amount of emitted light in the density sensor, a detection accuracy for the change of amount of emitted light is enhanced and the output of the density sensor is compensated.

In unexamined Japanese Patent Application Publication No. 2002-236402, it is suggested that using a regular reflection type density detection device and a diffusion reflection type density detection device, the output of the diffusion reflection type density detection device is compensated based on output values of the regular reflection type density detection device and the diffusion reflection type density detection device.

As above, various compensations for the density detected by the density sensor are suggested. As to elimination or suppression of the fluctuation, some technologies have solved by analyzing the change with time of the density sensor and factors of the fluctuation of the density sensor as the above publications study. However, as to variations of the density sensors due to the individual differences, the image forming apparatus is operated to form an image and the compensation is carried out by detecting the density of the output image.

In this case the fluctuation of the sensor outputs are reflected by an individual difference of the image forming device of the image forming apparatus and an individual difference of the whole image forming section of the image forming apparatus such as an individual difference of a reflection coefficient of the image carrier besides an individual difference of the density sensor. Conventionally compensation of such output fluctuations of the density sensor was carried out as follow through image forming.

More specifically, the image quality control, where a patch image is formed, the density of the patch image is detected by the density sensor and the result of detection is fed back to image forming, is carried out, thereafter the image is formed on a recording material.

Then the density of the image on the recording material is measured by a density meter or a calorimeter so that the density sensor is adjusted and the measurement becomes consistent.

As above, conventionally, the compensation for the fluctuation of the density sensor output used in the image quality control is carried out based on the measurement result by actually outputting the image on the recording material and measuring the density through a density meter or the calorimeter. Compensate is time consuming, and since automation of the compensation is difficult, a manufacturing cost and a maintenance cost increase.

SUMMARY OF THE INVENTION

An object of the present invention is to solve the above problem.

The above object is achieved by the following structure.

An image forming apparatus, having: an image carrier; a toner image forming device to form a toner image on the image carrier; a density sensor to detect an image density of the toner image; a density sensor calibration section to calibrate the output value of the density sensor; wherein the density sensor calibration section causes the toner image forming device to form a plurality of groups of toner images of reference patterns having different resolutions respectively for different image forming conditions on the image carrier; detects the output values corresponding to the image densities of the reference patterns of the plurality of the groups through the density sensor; obtains the output value of the density sensor as a reference value when the detected densities equate each other among the toner images of the reference patterns having different resolutions, formed in the same image forming condition; and calibrates the output value of the density sensor based on the reference value obtained thereby.

DETAILED DESCRIPTION OF THE PREFERRED EMBODIMENT

Figure 1:
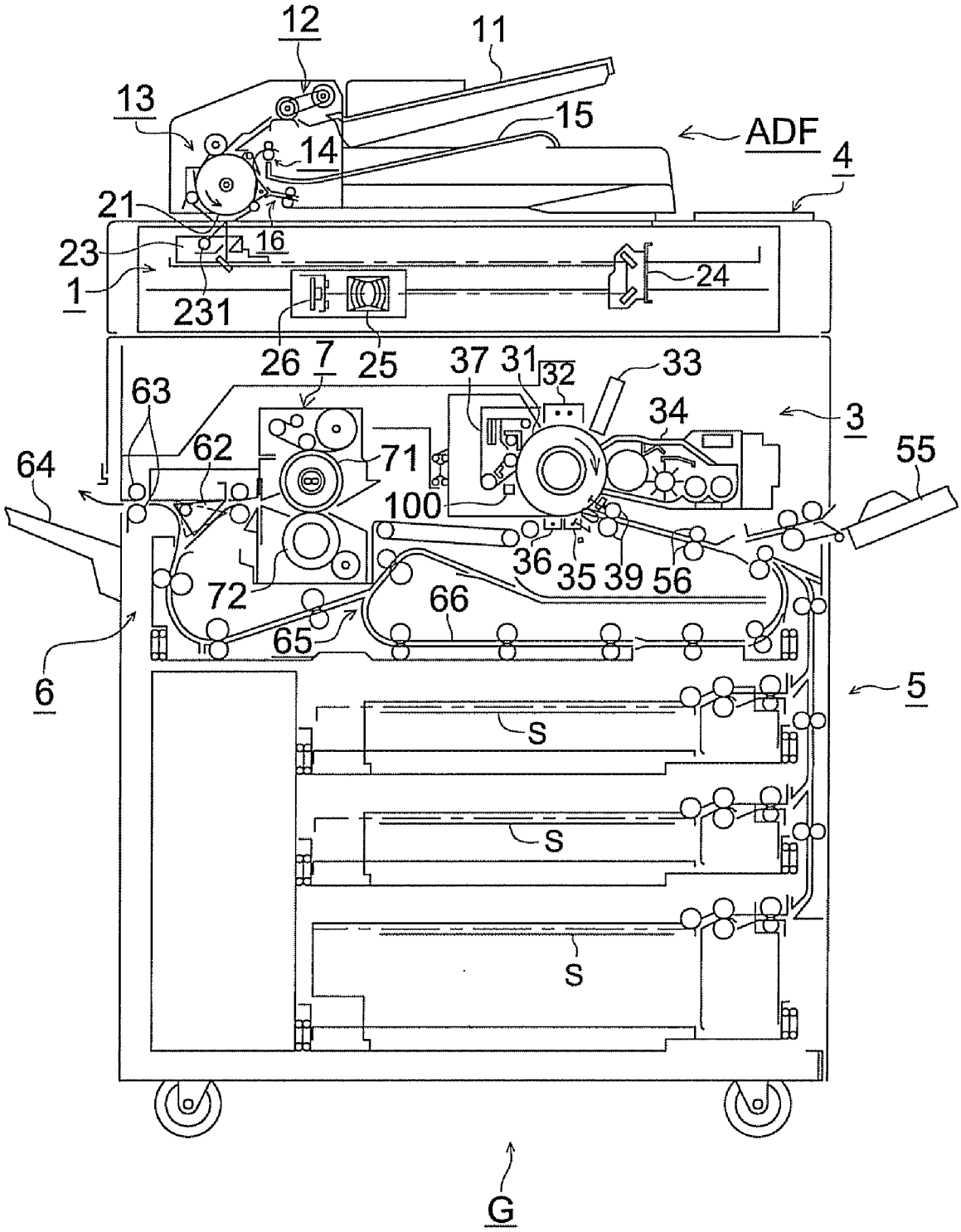
FIG. 1 is a view of an image forming apparatus related to the embodiment of the present invention.

FIG. 1 shows a schematic diagram of a configuration of an image forming apparatus G related to an embodiment of the present invention which is so called a multi function peripheral having functions of a copying machine, a facsimile machine and a printer.

The image forming apparatus G having an automatic document feeder ADF on an upper part of a main body thereof is configured with an image reading section 1, an image forming section 3, an operation display section 4, a sheet feeding section 5, a discharged sheet re-feeding section 6 and a fixing device 7.

The automatic document feeding apparatus ADF feeds the documents placed on a document loading table one by one through a document separating device 12 to a document conveyance device 13, and the document conveyance device 13 transfers the fed document to a document discharging device 14 then the document discharging device 14 discharges the document to a document discharging table 15. A document image is read by a slit provided at a document image reading position of the image reading section 1.

In case images of both sides of the document are read, a document turn over device 16 having a pair of rollers turns over the document, whose first side has been read, upside down then again the document is fed to the document conveyance device 13 so that a second side is read. The document, where reading has been completed, is discharged to the document discharging table 15.

The image reading section 1, which is a device to read the document image and obtain image data, forms a document image irradiated by a lamp 231 at a position of slit 21 on an imaging element 26 of CCD in shape of a line, through a first mirror unit 23, a second mirror unit 24 and an image forming lens 25. A signal outputted form the image element 26 is converted from analogue to digital and processed by shading correction and image compression then stored as image data.

An exposure device 33 having a laser diode as a light source forms an electrostatic latent image corresponding to the document image on a surface of a photoconductive substance 31, based on the image data, through a laser beam and a polygon mirror, by scanning the surface of the rotating photoconductive substance 31 which is charged evenly by a charging device 32.

The electrostatic latent image is developed reversely by a developing device 34 of the image forming section 3 to from a toner image on the photoconductive substance 31.

In accordance with a timing of the aforesaid toner image forming, a recording sheet S is fed from a manual sheet feeding section 55 or the sheet feeding section 5 having trays and cassette sections to store the recording sheet S presenting a transfer material, and is conveyed through conveyance rollers 56 then synchronized for positioning in respect to the toner image and then sent out to a transfer area.

In the transfer area, the toner image formed on the surface of the photoconductive substance 31 is transferred onto the recording sheet S which is charged in an opposite polarity through the transfer device 35.

The recording sheet S carrying the toner image is separated from the surface of the photoconductive substance 31 by operation of a separation discharging device 36 and conveyed to the fixing device 7.

In the fixing device 7, the recording sheet S carrying the toner image is conveyed while being heated and pressed through a heating roller 71 and a pressure roller 72 so that the toner image is fixed onto the recording sheet S, and discharged to a discharged sheet table 64 outside the apparatus through discharging rollers 63.

Meanwhile, in case the recording sheet S is discharged to the discharged sheet table 64 after turning over upside down, the recording sheet S is lead to the discharged sheet re-feeding section 6 though a switching guide 62 then switched back to be sent to the discharging rollers 63.

Also, in case the images are formed on both sides of the sheet S, after finishing fixing of a first side, the recording sheet S is lead to the discharged sheet re-feeding section 6 though a switching guide 62, then a turnover section 65 turns over the recording sheet S, thereafter the recording sheet S is sent to a conveyance path 66 for image forming on a second side.

On the other hand, a cleaning device removes remaining toner from the surface of the photoconductive substance 31 after finishing transferring the toner image onto the recording sheet S, so that the photoconductive substance 31 becomes ready for subsequent image forming.

In image forming, the electrostatic latent image is formed on the photoconductive substance 33 rotating in a clockwise direction as the arrow shows by charging of the charging device 32 and exposing of an exposing device 33, and the toner image is formed by developing of the developing device 34. The toner image formed is transferred onto the recording sheet S through a transferring device 35 and the toner image transferred is fixed by fixing device 7.

In the image forming apparatus, in conjunction with the above image forming, image quality control is carried out when the apparatus is started right after the main switch is turned on, when image forming is started by receiving an image forming command by tuning on a copy button or from external apparatuses or each time a prescribed number of image forming is completed.

Figure 2:
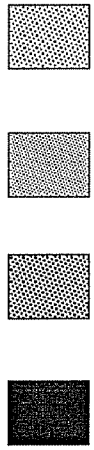
FIG. 2 is a diagram showing a reference pattern formed in image quality control.

Image quality control is feed back control, where, for example, a reference pattern shown in FIG. 2 is formed on the photoconductive substance 31 by charging, exposing and developing and passes through a position of the density sensor 100 without being transferred on the recording sheet, the density of the reference pattern is detected by the density sensor 100; and image forming conditions such as a charging condition of the charging apparatus 32, an exposing condition of the exposing device 33 and a developing condition of the developing device 34 are controlled based on a detected density. The above image quality control, which is carried out according to a publicly known method, is to control fluctuation of the image quality caused by change of environment or change of each section such as the photoconductive substance 31, the charging device 32, the exposing device 33, the developing device 34 and to realize stable image quality. As is commonly known, by driving the exposing device 33 based on image data having a predetermined density value, the toner image of the reference pattern shown in FIG. 2 is formed on the photoconductive substance 31.

Figure 3:
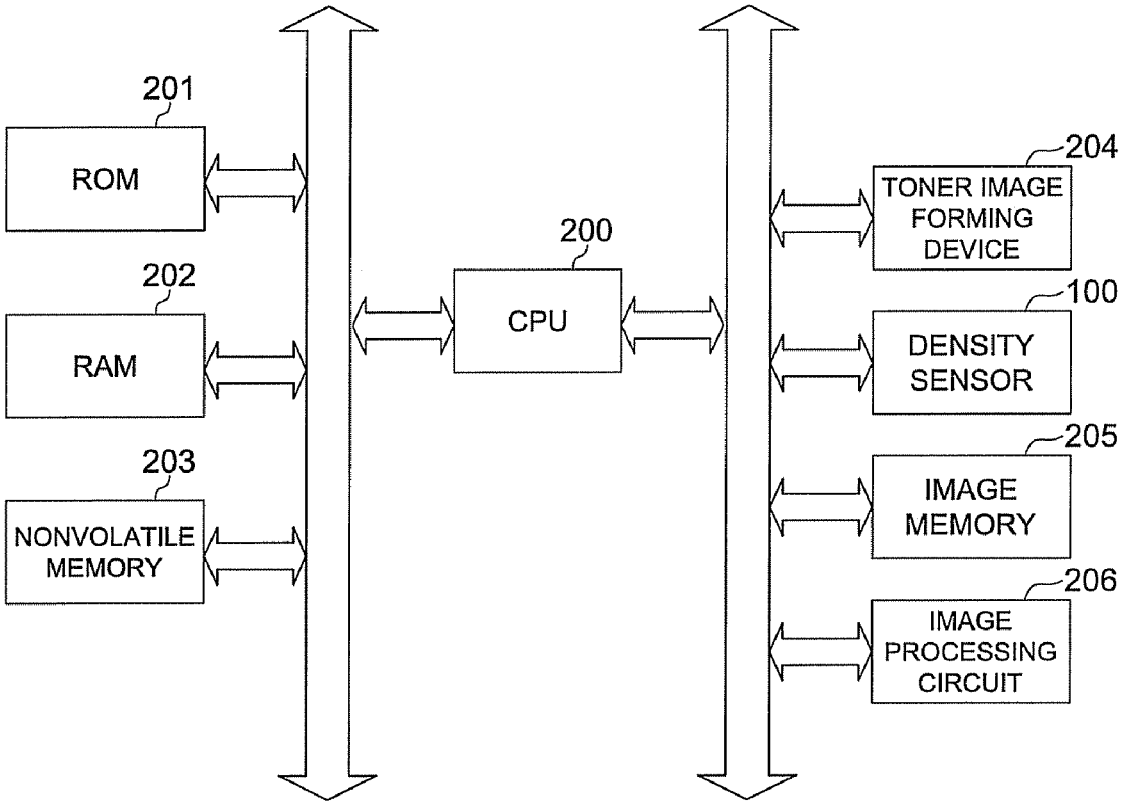
FIG. 3 is a block diagram of a control system to carry out image forming in the image forming apparatus, image quality control and density sensor calibration described below.

FIG. 3 is a block diagram of the control system to carry out image forming in the image forming apparatus and image quality control in the image forming apparatus shown in FIG. 1 and calibration of the density sensor described below.

CPU 200 is a device to carry out image forming control and image quality control described as above and configures a density sensor calibration section to carry out calibration of the density sensor 100 described next.

A ROM 201 memorizes various programs such as image forming, image quality control and density sensor calibration, a RAM 202 is a work area of the CPU 200, a nonvolatile memory 203 is a memory device to memorize various parameters including the reference value of the density sensor 100 described later. A toner image forming device 204 forms a toner image on the photoconductive substance 31 including the charging device 32, the exposing device 33 and the developing device 34 in FIG. 1. An image memory 205 stores image data, and an image processing circuit 206 creates image data to drive the exposing device 33.

In the image forming, the CPU 200 controls the toner image forming device 204 to form the image. In the image forming, the image data is supplied form the image memory 205, and based on image data processed by the image data processing circuit, the exposing device 33 of the toner image forming device 204 is driven to carry out exposing and forms the toner image.

In the image quality control, the image processing circuit 206 creates image data of the reference pattern and based on the image data of the reference pattern, the exposing device 33 is driven and a toner image of the reference pattern is formed on the photoconductive substance.

The CPU 200 controls the toner image forming device 204 based on an output of the density sensor 100 which detects an image density of the toner image of the reference pattern.

<Density Sensor>

Figure 4:
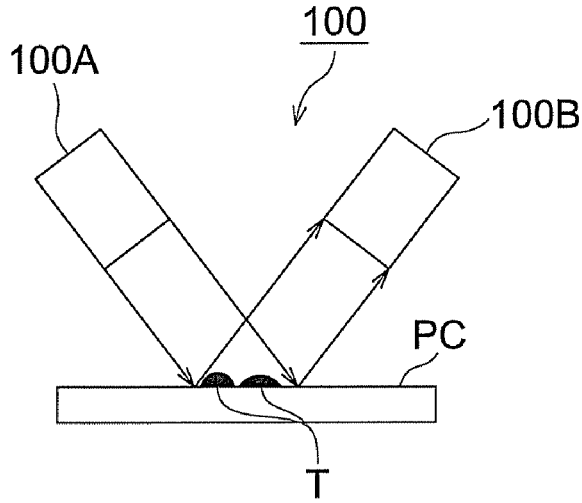
FIG. 4(*a*) and FIG. 4(*b*) are views showing a density sensor.
Figure 4:
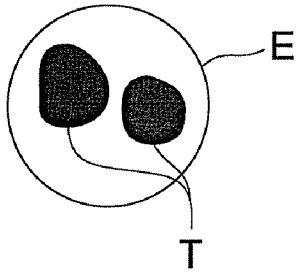

FIG. 4 shows the density sensor, FIG. 4(*a*) is a side view of the density sensor 100, and FIG. 4(*b*) shows a detection area of the density sensor 100. The density sensor 100 is a reflection type density sensor having LED 100A to radiate light towards image carrier PC such as the photoconductive substance and the intermediate transfer substance, and a photodiode 100B to receive the reflection light from the image carrier.

A density D of an image T on an image carrier P has a relation with a reflection rate R of a detection area E detected by the density sensor 100 described by the following equation (1).

$$D=-\log_{10} R \tag{1}$$

As FIG. 4(*b*) shows, there can be a case where a plurality of toner images T exist in the detection area E of the density sensor 100, and the reflection rate R, which is an average reflection rate in the area E, is described by the following equation (2).

$$R=Am\times DR+(1-Am)\times WR \tag{2}$$

Am is a blacking rate (coverage), namely a proportion of an area, in which the toner image T occupies, to the detection area E, DR is a reflection rate of toner configuring the toner image T and WR is a reflection rate of a background.

On the other hand, the printing rate as described later corresponds to an amount/ratio of image data for forming image in an unit area in the scale of the image data.

In the image forming where the present invention is used, a gradation image can be formed and the gradation image relates to the blacking rate.

Namely, by controlling a rate of an image forming area to an unit area the density of the image is controlled (area gradation method).

<Error of the Output of Density Sensor>

In the aforesaid image quality control, as described above, generally, the reference pattern such as a gray scale is formed on the image carrier and the density of the reference pattern is detected by the density sensor.

Meanwhile, there are individual differences between the sensors mounted in each image forming apparatus and the output of the density sensor changes due to change with time. Therefore there are problems that image quality control does not function correctly and deterioration of the image quality and fluctuation of image quality are caused. Consequently, the output of the density sensor has to be calibrated periodically or when the image forming apparatus is assembled or maintenance is carried out.

Next, an error, which occurs when the density sensor detects the density of the reference pattern, will be described.

For detection of the error of the density sensor, a line pattern image is used.

Figure 5:
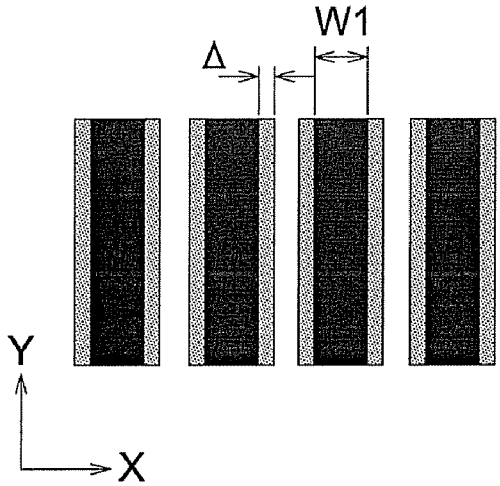
FIG. 5(*a*) and FIG. 5(*b*) are views showing line pair images.
Figure 5:
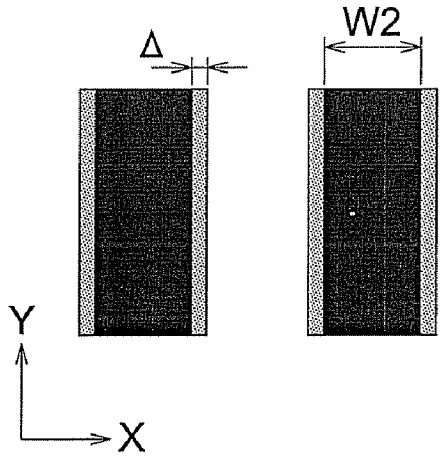

FIG. 5 shows a line pair image aiming the blacking rate of 50% which is formed by repeating white and black pairs. FIG. 5(*a*) shows a line pair image of 20 strips per mm and FIG. 5(*b*) shows the other line pair image of 10 strips per mm respectively. Namely, the resolution of FIG. 5(*a*) is two times as high as the resolution of as FIG. 5(*b*). Both images are formed with data having a printing rate of 50% aiming that the densities detected by the sensor become equal.

The line pair shown in FIG. 5 is formed by scanning exposure where a main scanning direction is denoted by X and a sub-scanning direction is denoted by Y. In exposure by a laser beam, the laser beam scanning is carried out in the X direction then the photoconductive substance is moved in the Y direction thus, the line pairs of FIG. 5 configured with lines parallel to the Y direction are formed.

Dot exposure is carried out by light emitting of the laser light source driven by pulses. A line is formed by forming the dots continuously in the Y direction.

A line width is determined by sizes of the dots and number of the dots continuing in the X direction. In an example of FIG. 5, a width W2 is two times as wide as the line width W1, and the line having the width W2 is formed by making the number of dots continuing in the X direction to be as two times as that of the line having the width W1.

In the FIG. 5(*a*) and FIG. 5(*b*), a black color image is an ideal image, however in an actual image a gray portion is formed together, therefore, the actual image is black plus gray, thus the FIG. 5(*a*) and FIG. 5(*b*) show a case that the actual image is formed thick in respect to the ideal image.

In each line, widths Δ of gray lines are unchanged even if the number of the lines, namely the width W1 and the width W2 of ideal line are different, and are the same in FIG. 5(*a*) and FIG. 5(*b*).

In case the detection area of the density sensor 100 covers four lines in FIG. 5(*a*) and two lines in FIG. 5(*b*), Sa=4×W1+8Δ(Sa is an printing area of the image in FIG. 5(*a*)) and Sb=2×W2+4Δ (Sb is an printing area of the image in FIG. 5(*b*)) are true.

FIG. 5(*a*) and FIG. 5(*b*) are formed as images having the same printing rate based on the image data having the same density. However, since 4×W1=2×W2, in actual printing areas, FIG. 5(*a*) becomes wider than FIG. 5(*b*) by the difference of the printing area 4Δ which is formed by making the image thick. Therefore, the density detected by the density sensor 100 in FIG. 5(*a*) becomes higher than that of FIG. 5(*b*). As above, in case of the resolutions differ, the image formed based on the image data having the same printing rate is detected by a density sensor as the image having different density.

<Calibration of Density Sensor>

A true output value or density value of density sensor where the line pattern is detected, namely an output value or density value in which the error is eliminated can be obtained by the following method.

Figure 6:
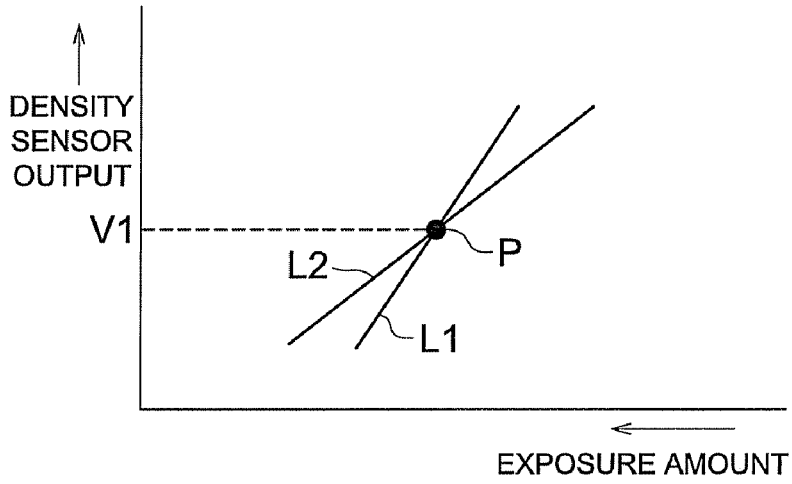
FIG. 6 is a graph showing a detected density of line pattern images.

FIG. 6 shows a relation between an amount of exposure for exposure based on density data for a predetermined printing rate and an output of the density sensor which detects the density of the formed image.

It is considered that a condition (pattern image forming condition) to form the pattern image is a factor to vary the blacking rate (coverage) though the density data of printing rate is the same as above. FIG. 6 shows detected densities of the line pair images of 20 strips per mm and 10 strips per mm where line pattern image is formed by changing the amount of exposure variously.

A horizontal axis in FIG. 6 shows the amount of exposure per pixel and a vertical axis shows the output of the density sensor 100 when the density of the line pattern is detected. A point P is a point where a density is equivalent to the blacking rate of 50%.

Since it is reverse development, as the amount of exposure decreases, the printing area decreases and the density decreases, and as the amount of exposure increases, the printing area increases and the density increases.

A Line L1 shows changes of detected density of the line pattern image of 20 strips per mm, and a Line L2 shows changes of detected density of the line pattern image of 10 strips per mm respectively.

As FIG. 6 shows, coverage is changed due to, for example, change of exposure condition even if the data is the same. The change of exposure condition is caused by change of the duty rate (for example exposing time of laser LED per one pixel) of the drive pulse to drive the exposing section (print head). When the density sensor 100 detects the density of the line pattern formed based on the image data having the same printing rate, the detected outputs of line patterns having different resolutions equate at an output V1 of the point P.

As described above, as the resolution becomes higher, the degree of increase of the density due to increase of the amount of exposure becomes larger. Therefore an inclination of the line L1 is higher than that of the line L2.

Since the line L1 and line L2 are substantially straight and have different inclinations, they intersect at the point P.

At the intersection P, the densities detected by the density sensor 100 equate. Namely, even if the resolution of the line pair image is changed, the density detected by the density sensor 100 is unchanged. The line pair image having a line width at the point P is a line pair image having an ideal line width without the error Δ being included.

This indicates that the error due to the gray area shown in FIG. 5 is eliminated at the point P, and the output V1 of the sensor at the point P can be used as the output of the density sensor when the density sensor detects the density of the line pattern having the printing rate of 50%.

Therefore, the output of the density sensor 100 at the point P is an output when detecting the image which is formed with a density of a designed value by exposing a predetermined amount of exposure. Using this output value as a reference value, the density is detected without errors, and correct image quality control is possible.

Meanwhile, in the above example, the line pattern, which the reference value correspond with, has the printing rate of 50%, however, values other than 50% are possible.

To obtain the point P in FIG. 6, by changing the exposure amount variously, the line width of the line pair is changed, values of detected density in respect to the exposure amounts at a plurality of points is obtained, and lines L1 and L2 are obtained from a plurality of the detected densities.

To change the exposure amount, the duty rate of the pulse to drive the exposure device such as a LD (laser diode) or a LPH (LED print head) is changed or a drive current is changed.

Figure 7:
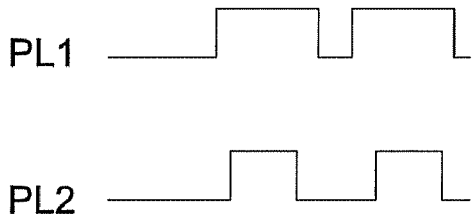
FIG. 7(*a*) and FIG. 7(*b*) are diagrams showing a voltage of a photoconductive substance and a diameter of a dot when a duty rate is changed.
Figure 7:
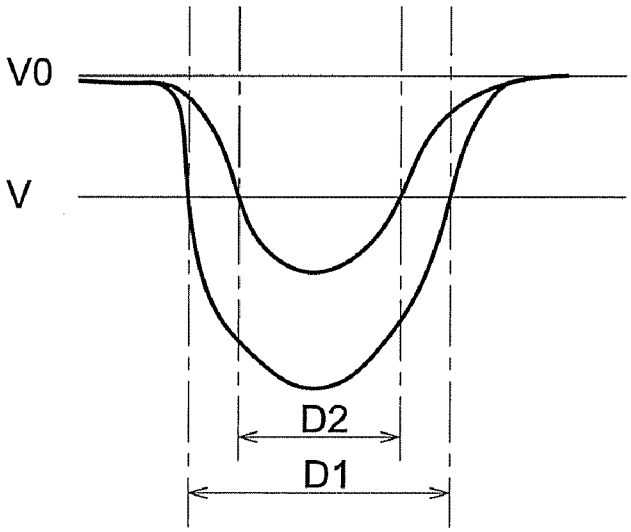

FIG. 7 shows change of a photoconductive substance voltage and change of a dot diameter of the image when the duty rate is changed.

FIG. 7(*a*) shows pulses having different pulse widths to drive the LPH and FIG. 7(*b*) shows a surface voltage of the photoconductive substance when exposing dots.

By driving the LPH with pulses PL1 and PL2 having different pulse widths, the photoconductive surface voltage is changed as FIG. 7(*b*) shows. Since a size of dot formed by exposing is corresponding to exposing energy, the line widths becomes distances D1 and D2 which are between around crossing points of the conductive substance voltage and a developing bias voltage V.

As above, by changing the duty rate, the dot diameter is changed, and consequently, the line width of the reference pattern is changed. Meanwhile, VO in FIG. 7(*b*) is a charging voltage of the photoconductive substance.

Since the outputs of the density sensor obtained by detecting the densities of the line patterns having different resolutions formed by the same exposure amount equate at the point P, the output of the density sensor at the point P can be the density of the line patterns in which the error is eliminated as described above.

In case the reference patterns having different resolutions are formed to obtain the output values of the density sensors, as the image forming conditions to be changed so as to detect the output values, besides the exposure amount described above, a charging condition and developing condition in developing are quoted. Further instead of the exposure amount, the charging condition or developing bias condition can be changed to obtain the output values of the density, furthermore image forming conditions where these conditions are combined can be changed variously to obtain the output values.

Reference patterns are formed by changing the above image forming conditions. Then in the case the outputs of the density sensor for the reference patterns that are formed by same image forming condition (except the resolution) and formed by different resolution are equate, the output is obtained as a reference value of the density sensor and correct image quality control can be realized by these process.

Figure 8:
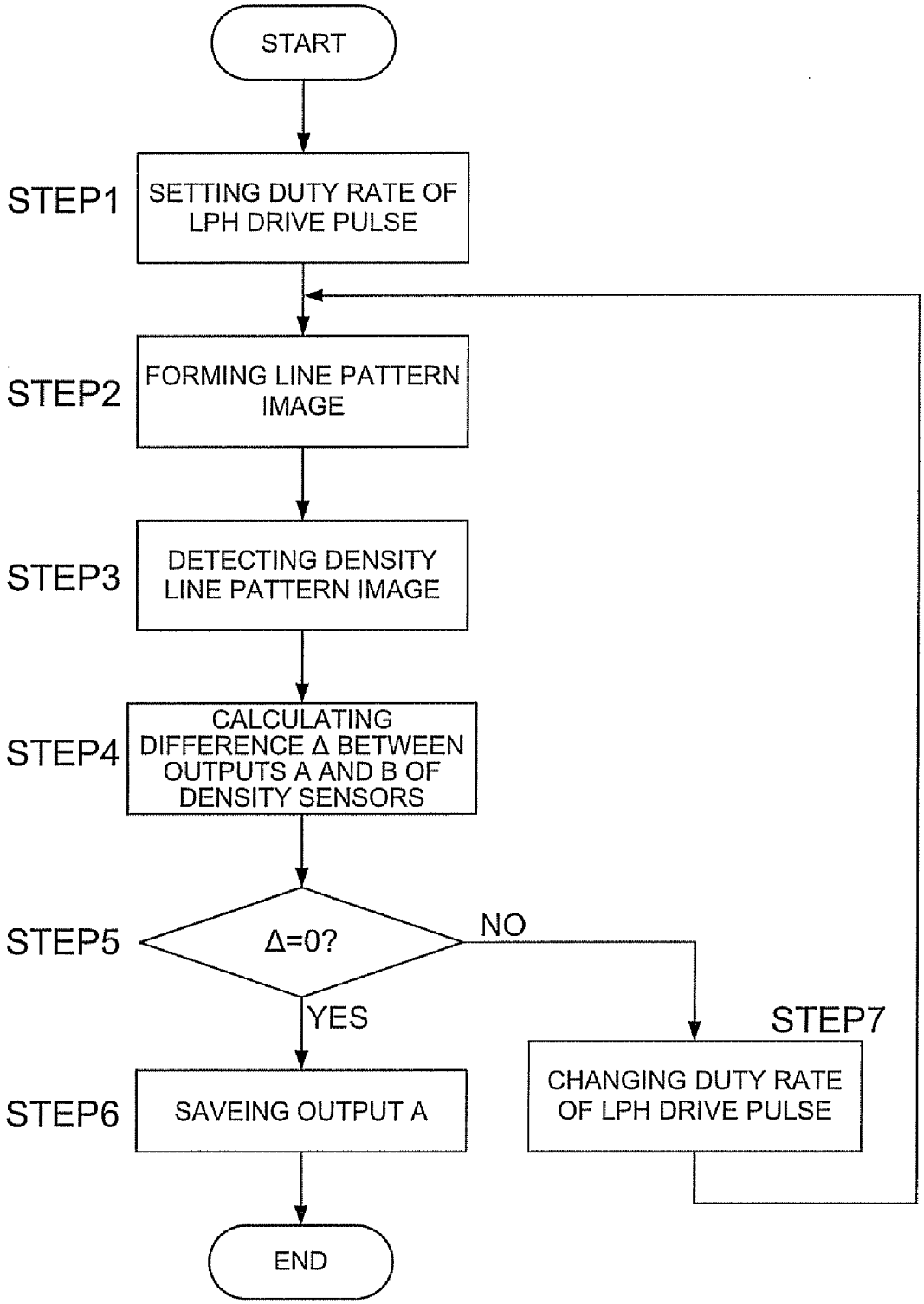
FIG. 8 is a flowchart of memorizing an output value in density sensor calibration.

FIG. 8 is a flowchart showing an example of memory of the output value in calibration of the density sensor. The present example is an example of calibration of the density sensor where a point, at which a fluctuation of the output of the density sensor is not caused by resolution of the image, is detected by repeating a loop of image forming and density detection, and an output of the density sensor at the point is set as a reference value.

In STEP 1, the duty rate of the drive pulse of LPH is set at an initial value, for example, 80'.

Figure 9:
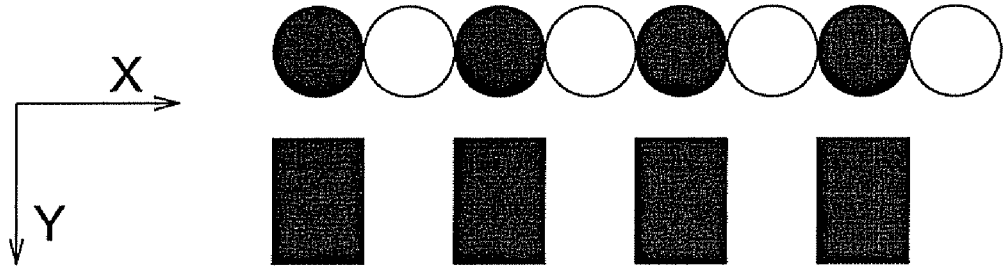
FIG. 9(*a*) and FIG. 9(*b*) are diagrams showing examples of line pair images.
Figure 9:
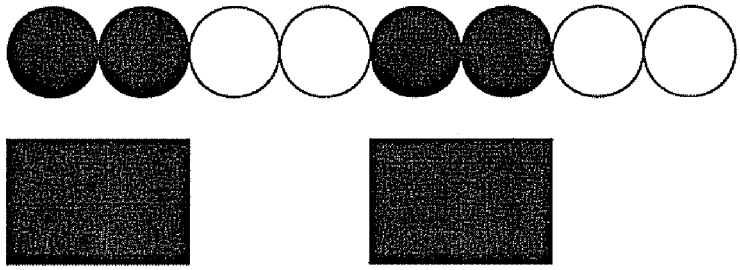

In STEP 2, an electrostatic latent image is formed and developed by driving LPH, thereby one dot line pair image in FIG. 9(*a*) and two dot line pair image in FIG. 9(*b*) are formed on the image carrier. In FIG. 9, the one dot line pair formed in the sub-scanning direction Y where white and black pixels are repeated for every one dot in the main scanning direction has a resolution which is two times as high as that of the two dot line pair where white and black are repeated for every two dots. Meanwhile, in FIG. 9, ● denotes a printed pixel and ○ denotes a non-printed pixel.

In STEP 3, an output of the density sensor which detects the line pattern is read, and in STEP 4, a difference Δ between an output A of the density sensor which has detected the density of the line pair image of FIG. 9(*a*), and an output B of the density sensor which has detected the density of the line pair image of FIG. 9(*b*), is calculated.

When the difference Δ=0, (STEP 5 Yes), the output A of the density sensor is memorized in a nonvolatile RAM 203 as a reference value (STEP 6).

The memorized reference value is used as an output of the density sensor in a reference blacking rate (coverage) in image quality control. In the above example, the reference blacking rate is 50% in FIG. 6, however, line pairs having different resolutions can be formed with the blacking rate other than 50% to obtain a reference density sensor output.

In case STEP 5 is No, namely, the output A is not equal to the output B. In STEP 7, the duty rate is changed and back in STEP 2, the line pair image is formed.

In STEP 7, the duty rate is changed in accordance with a magnitude relation of A and B, namely, when Δ is positive, in other words, the image is formed thinly, the duty rate is lowered, and when Δ is negative, in other words, the image is formed thickly, the duty rate is risen.

The loop of STEP 2 to STEP 7 is repeated unit the difference Δ=0, and at a stage when the difference Δ=0, the output A is memorized in a nonvolatile memory.

As described later, the memorized output A is used for density sensor calibration.

Figure 10:
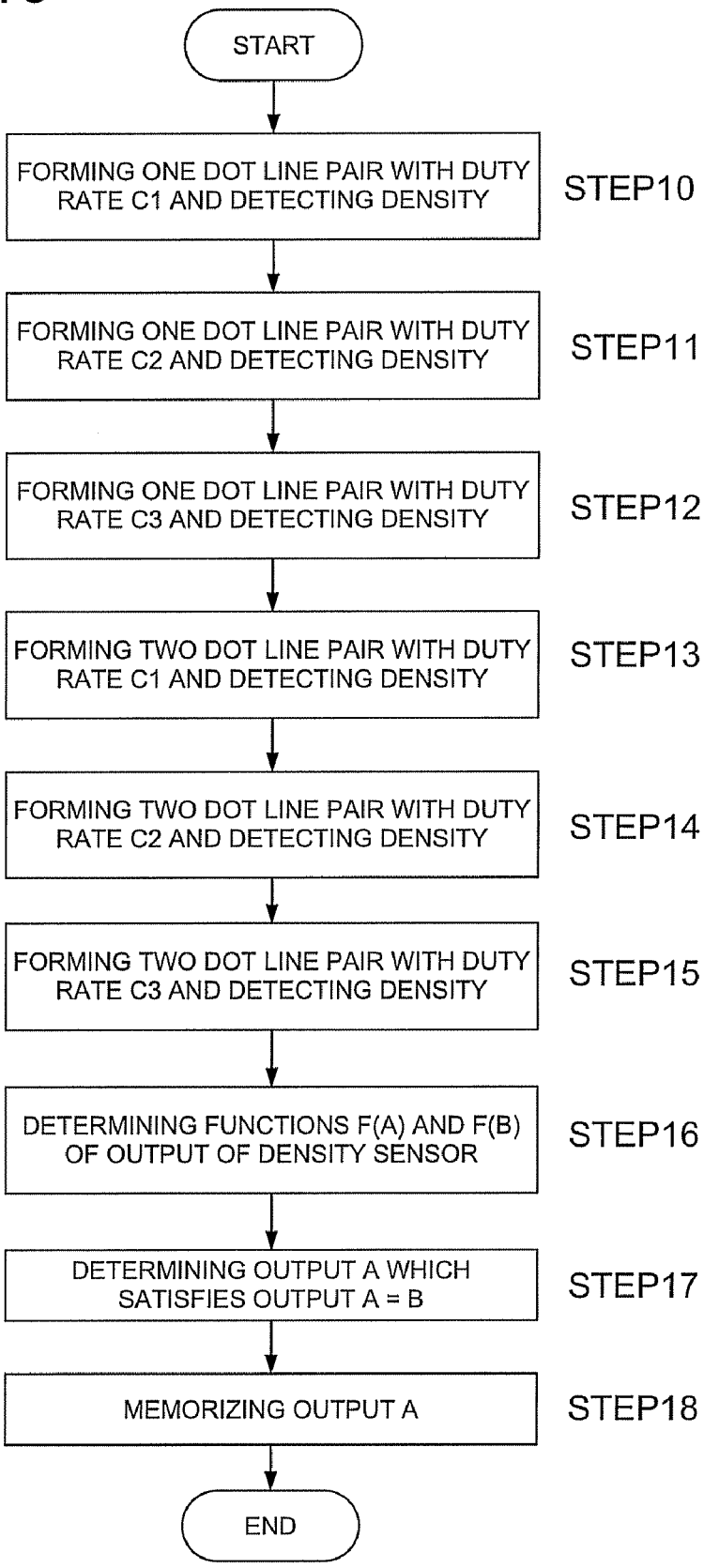
FIG. 10 is an exemplary flowchart of memorizing an output value in density sensor calibration.

FIG. 10 is another flowchart of memorizing an output value in density sensor calibration.

The present example is an example, wherein a value at a point, where the output of the density sensor is not fluctuated by the resolution of the image, is determined by calculation, and the sensor output value determined is memorized as a reference value.

In STEP 10, the one dot line pair image is formed with a duty rate of C1 and an output A1 corresponding to its density is detected by a density sensor.

In STEP 11 the one dot line pair image is formed with a duty rate of C 2 which is different from C1, and an output A2 corresponding to its density is detected by the density sensor.

In STEP 12, the one dot line pair image is formed with a duty rate of C 3 which is different from C1 and C2, and an output A3 corresponding to its density is detected by the density sensor.

In STEP 13, the tow dot line pair is formed with the duty rate of C1, and an output B1 corresponding to its density is detected by the density sensor.

In STEP 14, the two dot line pair image is formed with the duty rate of C2 which is different from C1, and an output B2 corresponding to its density is detected by the density sensor.

In STEP 15, the two dot line pair image is formed with the duty rate of C3 which is different from C1 and C2, and an output B3 corresponding to its density is detected by the density sensor.

In STEP 16, a density changing curve (equivalent to a curve L2 in FIG. 5), where the line width of the one dot line pair image is changed from the outputs A1 to A3 corresponding to its density, is determined by calculation, and a density changing curve (equivalent to a curve L1 in FIG. 5), where the line width of the two dot line pair image is changed from the outputs B1 to B3 corresponding to its density is determined by calculation.

A calculation in STEP 16 determines approximate curves (straight lines L1 and L2 in FIG. 6) to connect the densities at a plurality of the points and functions F(A) and F(B).

In STEP 17, the point (the point P in FIG. 6), where the values of functions F(A) and F(B) equate, is determined and the output A corresponding to the point P determined in STEP 18 is memorized in the nonvolatile memory RAM 203.

The memorized output A is used as a reference value in the image quality control.

Figure 11:
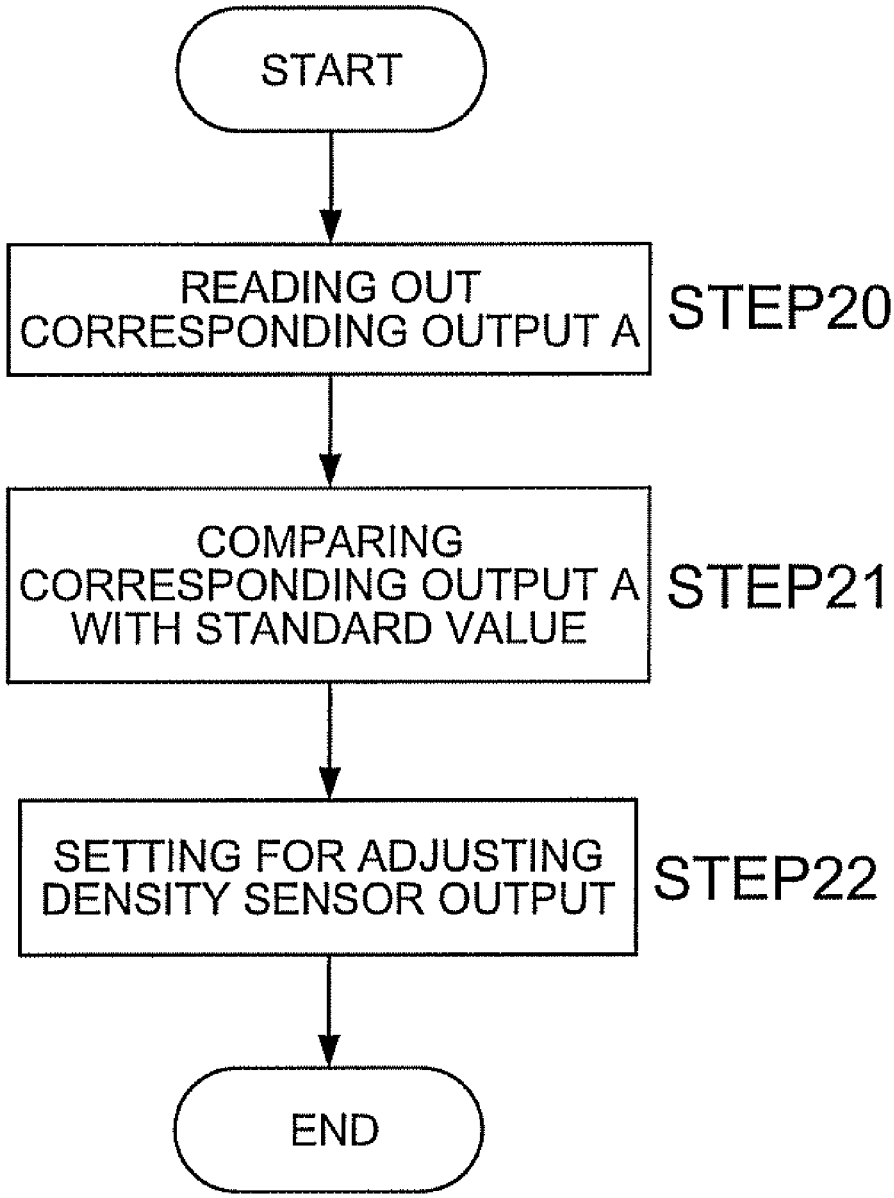
FIG. 11 is a flowchart of a density sensor calibration process.

FIG. 11 is a flowchart of a calibration process of the density sensor 100. Generally this configuration process is executed by the control device automatically subsequently to the aforementioned processes shown in FIG. 8 or FIG. 10.

In STEP 20, an output value A of the density sensor memorized in the nonvolatile memory 203 as an object of the calibration is read out.

In STEP 21, the output value A read out is compared with the standard value S1 (the value set as the standard of the density sensor output corresponding to the blacking rate (coverage) of the aforementioned line pair) memorized in the ROM etc, in advance.

In STEP 22, the control section controls so that the output of the density sensor becomes possible to be adjusted, using a difference between the aforesaid standard value S1 and the aforesaid output value A.

For example, if the standard value S1 for printing rate for above line pair is 3 V, and the output value read out from the nonvolatile memory 203 is 2.5 V, a calibration amount is made 0.5V to enable adjustment by rising the output of the density sensor by 0.5V, and the calibration amount is memorize in the nonvolatile memory. When the density sensor is used, the calibration amount is called up and used to calibrate the density sensor output (in this case 0.5V is added). Thereby, the same density sensor output is ensured for the image having the same printing rate.

In FIG. 1, there is a case where a plurality of the density sensors are provided. For example, to uniform the density in an axis direction of the photoconductive substance 31, the density sensors 100 are allocated in a plurality of positions in the axis direction of the photoconductive substance 31, namely a the density sensors 100 are allocated at near side end section and a back side end section in a direction perpendicular to the paper surface in FIG. 1. In the above configuration, the calibration of the outputs described above is carried out for the plurality of the density sensors respectively so as to equalize the density sensor outputs accurately.

Therefore, control device memorizes the above output values for the plurality of the density sensors respectively. Further, after the differences in respect to the standard value are set as the calibration amounts, by calling up the calibration amounts corresponding respective density sensors appropriately, the plurality of the outputs of the density sensors can be equated accurately.

In the manufacturing process of the image forming apparatus, calibration of the density sensor 100 described above is carried out at an adjusting stage of assembled image forming section 3 or the assembled image forming apparatus G during a manufacturing process of the image forming apparatus, at maintenance periods of the image forming apparatus G set in market place or at each timing for predetermined number of image forming process.

For example, the processes shown in FIG. 8 and FIG. 10, and the calibration process shown in FIG. 11 can be carried out by manual operation through the control device 200 in FIG. 3 by assembling worker or service staff.

In this case a density sensor calibration mode is provided. By operation of the operator, a shape of the aforesaid line pair and the comparison of the output values are conducted. Then output value memorized in the nonvolatile memory 203 are called up, and the output of the density sensor is adjusted based on the difference between the called up output value and the standard value.

Further, in calibration process shown in FIG. 11 or in the aforesaid manual calibration process, it is substantially possible to carry out the calibration of the density sensor 100 by adjusting other parameters in image quality control system, instead of adjusting the output of the density sensor 100.

For example, in case the image quality control is carried out through on/off control by discriminating the outputs of the density sensor using a threshold, it is possible to adjust the threshold based on the difference between the output value (reference value A) and the standard value (S1). That is, by memorizing the threshold in the nonvolatile memory 203 in advance, after the reference value A in determined, the difference between the reference value and the standard value corrects and supersedes the threshold. Thereby in subsequent image quality control, the density sensor output is practically calibrated and control is executed in the same manner.

Further, in case an intermediate image transfer substance is used as the image carrier such as in a color image forming apparatus, and image quality control is carried out using the reference pattern formed on the intermediate image transfer substance, the calibration of the density sensor described above is carried out by detecting the density of the reference patterns formed on the intermediated transfer substance through the density sensor 100.

In the image quality control in a color image forming apparatus, the reference patterns of yellow, magenta, cyan and black are formed on the intermediate transfer substance, the density of the reference patterns are detected by the density sensor and results of detection are fed back to the image forming conditions of respective image forming section. In this case the image forming apparatus is equipped with a plurality of toner image forming devices to form the toner images of different colors, on the other hand a common density sensor detects the density of each single color image. Further by calibrating the common density sensor through the method described above, the outputs of the density sensor for respective color can be calibrated. Therefore the image quality control of each single color image is correctly carried out, thus shifts of tone reproducibility, color hue, and color reproducibility are corrected sufficiently.

According to the above embodiments, the calibration of the density sensor output can be carried out only using the image forming apparatus without using special instruments such as the density meter and the calorimeter, and the density sensor can be calibrated at a low cost with a high efficiency, thus the image forming apparatus capable of forming the image having less fluctuation of the image quality can be realized.

Also, automation of calibration of the density sensor becomes possible.

What is claimed is:

1. An image forming apparatus, comprising:

an image carrier;

a toner image forming device structured to form a toner image on the image carrier;

a density sensor structured to detect an image density of the toner image and to output density value corresponding to the image density;

a controller structured to calibrate the density sensor based on a standard value;

wherein the image forming apparatus is structured to form a plurality of reference patterns, each of the plurality of reference patterns having a different resolution;

the image forming apparatus is structured to form each of the plurality of reference patterns at a plurality image forming conditions;

the density sensor is structured to detect densities of the plurality of the reference patterns at each of the plurality of image forming conditions, and output density values for each of the plurality of reference patterns at each of the plurality of image forming conditions; and the controller is structured to assign as the standard value the density value that is the same for each of the plurality of reference patterns for a given image forming condition.

2. The image forming apparatus of claim 1, further comprising a memory to memorize the standard value obtained, wherein the density sensor calibration section calibrates the output of the density sensor based on the standard value memorized in the memory and a reference value of the density sensor.

3. The image forming apparatus of claim 1, wherein the toner image forming device has an exposing device, and the image forming condition is an exposing condition of the exposing device.

4. The image forming apparatus of claim 3, wherein the density sensor calibration section changes the image forming condition by changing a duty rate of a pulse which drives the exposing device.

5. The image forming apparatus of claim 1, wherein the plurality of the reference patterns having different resolutions are the reference patterns having the same printing rate and the different resolutions.

6. The image forming apparatus of claim 5, wherein the reference patterns are patterns configured with a plurality of lines, and the plurality of the reference patterns having different resolutions are patterns having different widths of the lines, different distances between lines and the same rate of a printing area of a line portion with respect to an image forming area.

7. The image forming apparatus of claim 5, wherein the reference patterns are patterns configured with a plurality of lines, and the plurality of the reference patterns having different resolutions are patterns having different number of the lines within a predetermined scope of an image forming area and the same rate of a printing area of a line portion with respect to the image forming area.

8. The image forming apparatus of claim 1, wherein the toner image forming device has an exposing device and in scanning exposing by the exposure device, the reference patterns are configured with a plurality of lines formed parallel to a sub-scanning direction by on and off operation of the exposing device provided along a main scanning direction.

9. The image forming apparatus of claim 1, further comprising an image quality control section to carry out the image quality control based on the density value of the density sensor.

10. The image forming apparatus of claim 9, wherein the image quality control section changes a threshold for the image quality control based on a difference between a reference value and the standard value of the density sensor.

11. The image forming apparatus of claim 1, wherein the toner image forming device forms a gradation image through an area gradation method.

12. The image forming apparatus of claim 1, further comprising a plurality of the density sensors, wherein the density sensor calibration section obtains the density values for the plurality of density sensors respectively.

13. The image forming apparatus of claim 1, further comprising a plurality of the toner image forming devices to form the toner images having different colors each other, wherein the density sensor commonly detects the image densities of the toner images formed by the plurality of the toner image forming devices.

14. A method of calibration for use in an image forming apparatus comprising an image carrier, a toner image forming device to form a toner image on the image carrier, and a density sensor to detect an image density of the toner image, the method comprising:

repeatedly forming, for a plurality of image forming conditions, a plurality of toner images of reference patterns on the image carrier, each of the plurality of toner images of reference patterns having a different resolution;

for each of the plurality of image forming conditions, detecting the image density of each of the plurality of toner images of reference patterns and outputting a density value corresponding to the image density;

storing the density value as a standard value when the density value for each of the plurality of toner images of reference patterns is the same for a given image forming condition; and calibrating the density sensor based on the standard value.

* * * * *